United States Patent [19]

Kim

[11] Patent Number: 5,035,328

[45] Date of Patent: Jul. 30, 1991

[54] COMPOSITE TEAR STRIP OPENING DEVICE WITH CARRIER STRIP FEATURE

[76] Inventor: Myun H. Kim, 141 Meserole Ave. #2L, Brooklyn, N.Y. 11222

[21] Appl. No.: 536,537

[22] Filed: Jun. 12, 1990

[51] Int. Cl.[5] ..... B65D 65/26; B65D 65/34; B65D 75/68

[52] U.S. Cl. ..... 206/605; 206/616; 206/617; 206/618; 206/632

[58] Field of Search ..... 206/616, 617, 618, 605, 206/632; 428/343

[56] References Cited

U.S. PATENT DOCUMENTS

| | | | |
|---|---|---|---|
| 3,599,859 | 8/1971 | Maierson | 206/616 X |
| 4,795,035 | 1/1989 | Kim | 206/617 X |
| 4,877,139 | 10/1989 | Kim | 206/605 X |
| 4,902,142 | 2/1990 | Lammert et al. | 206/618 X |
| 4,936,464 | 6/1990 | Kim | 206/617 |

*Primary Examiner*—George F. Lesmes
*Assistant Examiner*—D. R. Zirker
*Attorney, Agent, or Firm*—Schweitzer Cornman & Gross

[57] ABSTRACT

A composite guide strip structure is disclosed, for use as a tear opening element for a container wall. A pair of guide strip elements are mounted on a carrier strip in spaced-apart, parallel relation. The carrier strip is of a material that tears easily, at least in the lengthwise direction, while the guide strips are resistant to tear in the lateral direction. The composite structure is adhesively secured to the outside wall of a container, either by adhesively securing the carrier strip itself, or by adhering the spaced-apart guide strip elements, with the carrier strip on the outside. A tear band is normally mounted on the interior surface of the container wall, opposite the spaced between the respective guide strip elements. The composite structure advantageously is supplied in roll form, for easy, convenient application to the container wall, enabling a plurality of guide strip elements to be applied in a single structure.

10 Claims, 2 Drawing Sheets

COMPOSITE TEAR STRIP OPENING DEVICE WITH CARRIER STRIP FEATURE

BACKGROUND AND SUMMARY OF THE INVENTION

The present invention is directed to tear strip opening devices for containers and more particularly to an improved such device of the general type comprising a pair of spaced-apart guide strip elements extending along the wall of a container and adhered thereto, and a tear band element adhered to the interior surface of the same container wall, aligned with the space between the guide strip elements mounted on the outside surface of the container wall. Tear strip opening devices of this general construction are known. The present invention, however, is directed to improvements in the construction of such devices, to enable them to be utilized more efficiently and economically.

In accordance with the invention, an independent, composite guide strip structure is provided which includes a thin, relatively wide carrier strip, formed of a material easily tearable in at least the longitudinal direction. Spaced-apart guide strip means are bonded to one surface of the carrier strip, along the marginal side edge portions thereof, with the carrier strip spanning the space between the respective guide strip means. The composite structure enables the spaced apart guide strip means, each of which may comprise a plurality of strip-like elements to be handled as a single element, simplifying and expediting the application of the opening device to container wall by reducing the number of elements required to be handled.

In one advantageous form of the invention, a carrier strip carries spaced apart guide strip means on one surface thereof and is adhesively coated on the opposite surface. When the composite structure is applied to a container wall, the respective spaced-apart guide strip means are bonded to the wall of the container by means of the interposed thin carrier strip. In another advantageous form of the invention, the spaced-apart guide strip means are bonded to one surface of the carrier strip, and the guide strip means themselves are adhesively bonded to the container wall, with the carrier strip on the outside.

For a better understanding of the above and other features and advantages of the invention, reference should be made to the following detailed description of preferred embodiments of the invention, and to the accompanying drawings.

DESCRIPTION OF PREFERRED EMBODIMENTS OF THE INVENTION

Figure 1:
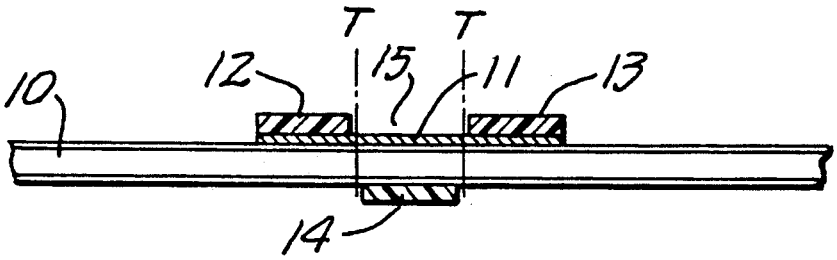
FIG. 1 is a cross-sectional view illustrating a container wall having the new composite guide strip structure mounted on its exterior surface, with a tear band on the interior surface of the container wall, opposite the space between the guide strip means.

Referring now to the drawing, and initially to FIG. 1 thereof, the reference numeral 10 designates a container wall on which the tear strip opening device is mounted. The container may be of any type, of hard or soft construction, and the material of the container wall may be of any material suitable for the purpose, capable of being torn in at least one direction. Corrugated board, paper board, paper, plastic, and foil/plastic combinations are typical materials.

In accordance with the invention, the tear strip opening device comprises a carrier strip 11, which is in the form of a relatively wide, continuous length of material. The material of the carrier strip is easily tearable in at least the longitudinal direction and, in general, can be of relatively low strength material, such as thin, tearable plastic, metal foil, or paper, for example.

In the embodiment of FIG. 1, a pair of elongated guide strips 12, 13 are adhesively or otherwise bonded to the upper surface of the carrier strip 11, along the opposite side edge margins of the carrier strip, preferably such that the outer edges of the guide strips are generally even of the outer edges of the carrier strip. The width of the carrier strip 11 is such, in relation to the width of the guide strips 12, 13, as to provide a substantial spacing between the inner edges of the guide strips. The guide strips are formed of a material that is resistent to tearing in at least the width-wise direction. Suitable materials for the purpose can be plastic, reinforced paper, fiberglass reinforced materials, metal foils, and the like.

Figure 3:
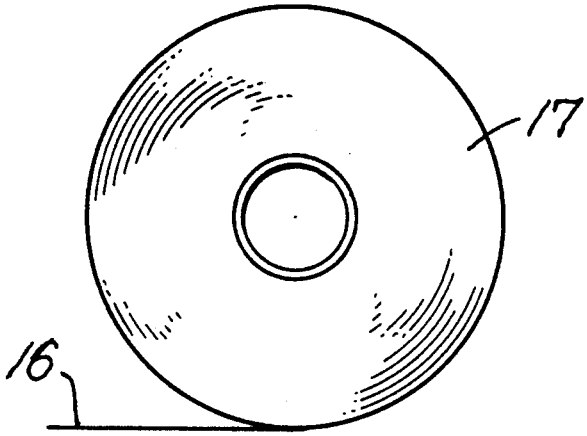
FIG. 3 is an elevational view of the composite guide strip material of the invention in roll form.

Pursuant to the invention, the carrier strip 11, and the guide strips 12, 13 bonded thereto, constitute an independent composite structure 16, which is typically provided in the form of a continuous roll (see FIG. 3). In the modification of FIG. 1, the bottom surface of the carrier strip 11 is provided with an adhesive coating, by means of which the structure is attached to the outer surface of the container wall 10. The guide strip structure typically is applied to a container wall, from one end edge to the other thereof. In conjunction therewith, a tear band 14 is mounted on the inner surface of the container wall, directly opposite the space 15 between the respective guide strips, and extending longitudinally generally coextensively with the guide strip structure applied to the outer surface. The tear band 14 typically is slightly narrower in width than the width of the space 15, and is formed of a relatively strong material, such as plastic, reinforced paper, metal foil, or the like. In accordance with known principals, when the tear band 14 is gripped at one end and pulled outward, the container wall 10 is caused to be severed along tear lines T between the inner edges of the guide strips 12, 13. The central portion of the carrier strip 11 is, of course, torn away along with the torn-out strip-like section of the container wall. Ideally, the character of the carrier strip 11 is such that it offers little additional resistance to the tearing operation.

In the modification of FIG. 1, the respective guide strips 12, 13 are effectively bonded to the outer surface of the container wall 10 by way of the interposed carrier strip 11. Accordingly, the material of the carrier strip must be sufficiently strong in the thickness direction to retain the guide strips 12, 13 firmly on the surface of the container wall during the tearing operation.

The composite guide strip structure 16 of FIG. 1 (and also of the other modifications to be described) is advantageously provided in the form of a roll 17, as shown in FIG. 3. The arrangement enables the structure, including the spaced guide strip elements 12, 13, to be applied as a single composite element to the wall of the container, so that the application of the tear strip opening device is quick and efficient, economical, and highly uniform.

Figure 2:
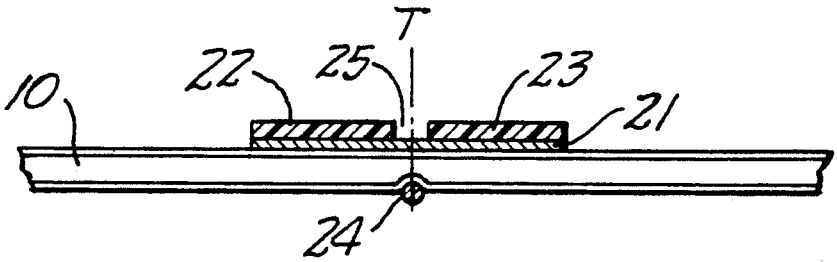
FIG. 2 is a view similar to FIG. 1, of a modified form of the invention, wherein the space between guide strip means is relatively small, and the internal tear band element is in the form of a wire of string.

The modification of FIG. 2 is closely related to that of FIG. 1. A carrier strip 21, formed of a material easily tearable in at least the longitudinal direction, mounts guide strips 22, 23 extending lengthwise to the carrier strip along each of its side edge margins. The space 25 between the inner edges of the respective guide strips 22, 23 is, in the FIG. 2 modification, relatively narrow. The bottom surface of the carrier tape is coated with an adhesive by means of which the independent structure, comprising the carrier strip and the spaced guide strips 22, 23, is applied as a unit to the outer wall of the container. In the FIG. 2 illustration, the tear band element 24, mounted to the internal surface of the wall 10, is in the form of a narrow wire or string, for example, which is aligned longitudinally with the relatively narrow space 25 between the guide strips. The tear band may be partially impressed onto the container wall as shown.

Figure 4:
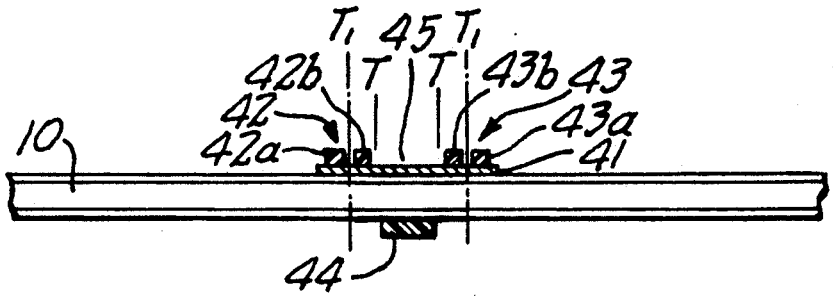
FIGS. 4 and 5 are views similar to FIGS. 1 and 2 of further modifications of the invention, FIG. 4 illustrating the guide strip means in the form of a plurality of narrow strips, and FIG. 5 illustrating relatively wide guide strip elements projecting beyond the edges of the carrier strip.

In the modification of FIG. 4, the composite guide strip structure comprises a carrier strip 41 of a material easily tearable in at least the longitudinal direction. Guide strip means 42, 43 are adhesively bonded to the upper surface of the carrier strip, along its opposite edge margins, extending longitudinally of the carrier strip and being generally coextensive therewith. In the FIG. 4 modification, the respective guide strip means 42, 43 each consists of a plurality of separate, narrow strip-like elements **42*a*, 42*b*, and 43*a*, 43*b*. The innermost of the strip-like sections 42*b*, 43*b* are relatively more widely separated to form a tearing space 45, and a tear band 44 of appropriate material is adhered to the inside surface of the container wall, generally aligned with the space 45** and coextensive with the length of the guide strip structure on the outside surface of the wall.

As in the case of the previously described embodiments, the carrier strip 41 is adhesively coated on its bottom surface, so that the independent, composite structure comprising the guide strip means 42, 43 and the carrier strip 41 may be applied as a single unit to the wall of the container, with the several strip-like elements **42*a*, 42*b*, 43*a*, 43*b* being applied in a single operation, uniformly aligned, etc., in a highly efficient manner. The modification of FIG. 4 enables, where appropriate, the tear line of the container wall to be formed not only between the inner edges of the innermost strip-like sections 42*b*, 43*b*, along lines T—T but alternatively, if desired, along lines between the individual guide strip elements, for example along lines T′—T′. This would, of course, be a function of the width and positioning of the tear band 44 in relation to the number and spacing of the individual strip-like elements mounted on the upper face of the carrier strip 41**.

Figure 5:
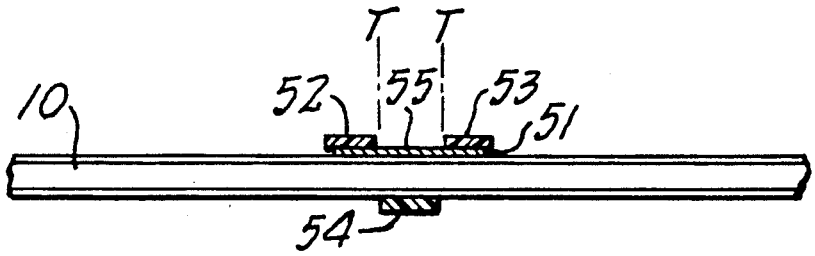

In the modification of FIG. 4, the carrier strip 41 is shown to extend slightly beyond the outer edges of the guide strip means 42, 43. In the modification of FIG. 5, a carrier strip 51 mounts guide strips 52, 53 on its upper surface. In the FIG. 5 modification, however, the geometry of the carrier strip 51 and guide strips 52, 53 is such that outer marginal portions of the guide strips project beyond the edge extremities of the carrier strip 51. The guide strips are separated by a space 55, and a suitable tear band 54 is mounted to the inside surface of the container, below and extending generally coextensive with the space 55.

Figure 6:
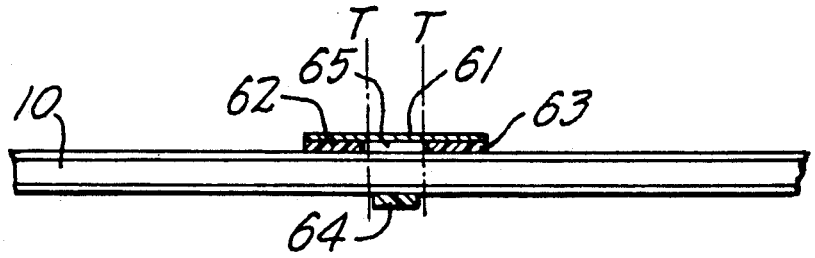
FIG. 6 is a cross-sectional view, similar to FIG. 1, illustrating a form of the composite guide strip structure in which the carrier strip is on the outside of the guide strip means, when the structure is mounted on the container wall.

In all of the modifications described so far, the guide strip means are bonded to the outer surface of the container wall through the interposed material of the carrier strip. In the modification of FIG. 6, a carrier strip 61 mounts a tear of guide strips 62, 63 on its "bottom" surface. The guide strips extend along the opposite side margins of the carrier strip such that the inner edges of the guide strips are spaced apart, forming a tear space 65 therebetween. A tear band 64 is bonded to the lower surface of the container wall, opposite and coextensive with the tear space 65. As in the other embodiments, the tear band 64 is advantageously slightly narrower than the width of the tear space 65, enabling a strip of the container wall to be torn out, generally along the tear lines T for opening of the container.

In the modification of FIG. 6, the composite guide strip structure is prepared with adhesive coatings applied to the exposed surfaces of the respective guide strips 62, 63. The structure is applied to the container wall so as to adhesively bond the guide strips directly to the wall outer surface. The carrier strip 61, in the finished product, lies outside of and covers the guide strips.

In the modification of FIG. 6, since the guide strips are bonded directly to the container wall, the carrier strip is not required to have any strength in the thickness direction. It need be no stronger than necessary to serve as a carrier for the respective guide strips 62, 63, during the handling and application of the strips to the surface of the container wall. Thereafter, the carrier strips serve only a decorative function.

Figure 7:
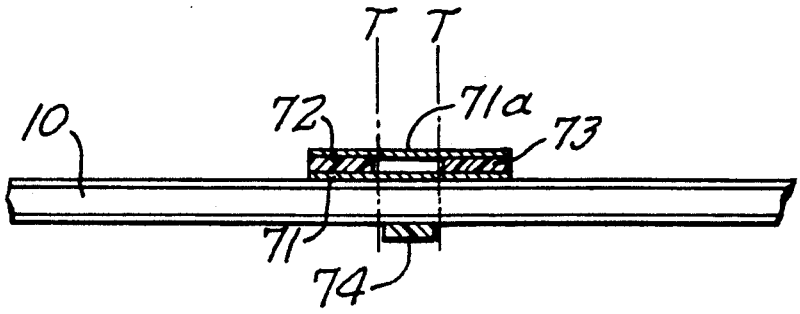
FIG. 7 is a cross-sectional view, similar to FIG. 6, illustrating a form of the invention in which carrier strips are provided on both sides of the guide strip means.

In the modification of FIG. 7, a spaced-apart guide strip elements 72, 73 are "sandwiched" between a pair of opposed carrier strips **71, 71*a*. Conveniently, one of the carrier strips can be coated with adhesive for mounting on the surface of the container wall, while the opposed carrier strip can be printed with information and/or decorative material. A tear band 74** is mounted to the opposite surface of the container wall.

In any of its various forms, the composite guide strip structure of the invention has significant practical advantages over known tear strip opening devices. Thus, while the general tear strip structure, comprising a pair of spaced guide strips on the outside surface of a container wall, cooperating with a tear band on the inner surface of the wall, is well known, the structure of the present invention enables that generally known tear strip device to be employed more easily and more economically and with a greater degree of uniformity, by reason of the independent, composite guide strip structure. With the applicant's invention, two or more guide strip elements are handled and applied to the container wall as a single unit, by reason of their being previously mounted upon a carrier strip element. The carrier strip itself serves only a minimal structural function in the actual opening of the container, as it is designed to offer minimum tearing resistance in at least the longitudinal direction.

In the modifications of the invention wherein the guide strip elements are bonded to the container wall through the interposed thickness of the carrier strip, the carrier strip need only have sufficient integrity in the thickness direction to cause the guide strips to be secured to the container wall with sufficient effectiveness to be retained in place during the tearing out of a strip of the container wall between the guide strips. A large variety of carrier strip materials satisfy this requirement, including various plastic film, papers, thin metal foils, etc.

Where the composite guide strip structure is applied to the container wall, with the carrier strip on the outside, the physical requirements of the carrier strip are even fewer. The carrier strip need only be strong enough to support the guide strip elements in their desired spaced relation, during the handling and application of the guide strip structure. In the latter modification, in addition, the exposed surface of the carrier strip can be printed with decorative material, instructions, or advertising, for example.

It should be understood, of course, that the specific forms of the invention herein illustrated and described are intended to be representative only, as certain changes may be made therein without parting from the clear teachings of the disclosure. For example, in any of the modifications described, the guide strip elements may be formed not only of plastic strips, but also of string, wire, beads of hot melt material, and the like. Accordingly, reference should be made to the following appended claims in determining the full scope of the invention.

I claim:

1. A tear strip opening device for opening of a container wall, wherein a pair of spaced-apart, elongated guide strip means are mounted in parallel relation on the outer surface of a tearable container wall, and an elongated tear band element is mounted on the inside surface of the container wall, generally opposite the space between said guide strip means, characterized by (a) said opening device comprising an independent, composite guide strip structure, separate from said tear band element, including a thin carrier strip formed of a material easily tearable in the longitudinal direction, and spaced-apart parallel guide strip means bonded to said carrier strip and extending lengthwise thereof, (b) said composite guide strip structure being adhesively secured to said outside surface of the container wall, whereby said guide strip means are effectively bonded to said outside surface, with the space therebetween being aligned with said tear band element on the opposite side of the container wall.

2. A tear strip opening device according to claim 1, further characterized by, (a) the surface of said carrier strip opposite to said one surface thereof being adhesively bonded to said outside surface of the container wall, (b) said carrier strip being formed of a material sufficiently strong in the thickness direction to effectively secure said guide strip means to said container wall outer surface to enable said container wall to be severed by pulling said tear band outwardly between said guide strip means.

3. A tear strip opening device according to claim 1, further characterized by, (a) said guide strips being adhesively secured to said container wall outside surface, and (b) said carrier strip being positioned on the outside of said guide strip means.

4. A tear strip opening device according to claim 1, further characterized by, (a) said spaced-apart guide strip means each comprising a plurality of individual strip-like elements of relatively narrow width bonded to said carrier strip.

5. A tear strip opening device according to claim 1, further characterized by, (a) said spaced-apart guide strip means extending along the marginal side edges of said carrier strip and covering the said one surface of said strip except for a predetermined central portion thereof.

6. A tear strip opening device according to claim 5, further characterized by, (a) the predetermined central portion of said carrier strip being of significantly less width than the respective spaced-apart guide means, and (b) said tear band element comprising a narrow, wire-like element positioned on the inside surface of said container wall generally opposite to said predetermined central portion.

7. A tear strip opening device according to claim 1, further characterized by, (a) said guide strip means comprising relatively wide, flat strip-like elements of material resistant to tearing in the widthwise direction, and (b) outer marginal edge extremities of said strip-like elements projecting laterally outward of the opposite side edges of said carrier strip.

8. A tear strip opening device according to claim 1, further characterized by (a) said tear strip opening device being furnished in the form of a continuous length in roll form.

9. A tear strip opening device according to claim 1, further characterized by (a) a second carrier strip being bonded to said guide strip means on the opposite sides thereof from the first mentioned carrier strip.

10. A tear strip opening device according to claim 1, further characterized by, (a) said guide strips being formed of materials selected from plastic, reinforced paper, fiberglass reinforced materials, metal foils, strings, wires, beads of hot melt material.

* * * * *